US010029343B2

(12) United States Patent
Shinozaki

(10) Patent No.: US 10,029,343 B2
(45) Date of Patent: Jul. 24, 2018

(54) POLISHING APPARATUS

(71) Applicant: EBARA CORPORATION, Tokyo (JP)

(72) Inventor: Hiroyuki Shinozaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 259 days.

(21) Appl. No.: 14/722,748

(22) Filed: May 27, 2015

(65) Prior Publication Data

US 2015/0343593 A1 Dec. 3, 2015

(30) Foreign Application Priority Data

May 30, 2014 (JP) ..... 2014-112479

(51) Int. Cl.
*B24B 37/005* (2012.01)
*B24B 37/10* (2012.01)

(52) U.S. Cl.
CPC ..... *B24B 37/005* (2013.01); *B24B 37/107* (2013.01)

(58) Field of Classification Search
None
See application file for complete search history.

(56) References Cited

U.S. PATENT DOCUMENTS 3,966,280 A * 6/1976 Olrik ..... F16H 19/025 74/25
5,951,368 A 9/1999 Watanabe et al.
6,280,292 B1 8/2001 Sato et al.
6,322,434 B1 11/2001 Satoh et al.
6,354,907 B1 3/2002 Satoh et al.
8,100,739 B2 1/2012 Yasuda et al.
2014/0370794 A1* 12/2014 Fukushima et al. .... B24B 37/32 451/387
2015/0024662 A1* 1/2015 Duescher ..... B24B 37/30 451/41
2015/0328743 A1* 11/2015 Nabeya ..... B24B 37/32 451/288
2015/0343593 A1* 12/2015 Shinozaki ..... B24B 37/107 156/345.13

FOREIGN PATENT DOCUMENTS

JP 09-207065 A 8/1997
JP 10-58308 A 3/1998
JP 2000-52233 A 2/2000

OTHER PUBLICATIONS

Singapore Search Report issued in Patent Application No. SG 10201504229U dated Oct. 5, 2017.

* cited by examiner

*Primary Examiner* — Sylvia MacArthur
(74) *Attorney, Agent, or Firm* — Pearne & Gordon LLP

(57) ABSTRACT

A polishing apparatus capable of correcting an inclination of a polishing head is disclosed. The polishing apparatus includes: a polishing table configured to support a polishing pad thereon; a polishing head configured to press a substrate against the polishing pad; a rotational shaft coupled to the polishing head; a self-aligning rolling bearing that tiltably supports the rotational shaft; a radial rolling bearing that receives a radial load of the rotational shaft; a detector configured to detect an inclination of the rotational shaft; and an inclination adjusting device configured to adjust the inclination of the rotational shaft.

11 Claims, 8 Drawing Sheets

POLISHING APPARATUS

CROSS REFERENCE TO RELATED APPLICATION

This document claims priority to Japanese Patent Application Number 2014-112479 filed May 30, 2014, the entire contents of which are hereby incorporated by reference.

BACKGROUND

FIG. 7 is a schematic perspective view showing a chemical mechanical polishing (CMP) apparatus. As shown in FIG. 7, the CMP apparatus is configured to supply slurry from a nozzle 102 onto a polishing pad 101 mounted on a rotating polishing table 100, while pressing a wafer W against the polishing pad 101 to thereby polish a surface of the wafer W. The wafer W is rotated by a polishing head 105 while being pressed against a polishing surface 101*a* of the polishing pad 101. The surface of the wafer W is polished by a combination of a chemical action of the slurry and a mechanical action of abrasive grains contained in the slurry.

During polishing of the wafer W, as shown in FIG. 8, flow of the slurry is formed between the wafer W and the polishing pad 101 due to a pumping effect of the wafer W, because the wafer W is being rotated by the polishing head 105. Such flow of the slurry affects a pressure of the slurry applied to the surface of the wafer W. When a table surface of the polishing table 100 and a wafer holding surface of the polishing head 105 are parallel to each other, a pressure distribution of the slurry is concentric with the center O of the wafer W as shown in FIG. 9.

However, when the polishing head 105 tilts, the flow of the slurry changes, resulting in a change in the pressure distribution of the slurry as shown in FIG. 10. If the center of the pressure distribution deviates from the center O of the wafer W, the pressure of the slurry acting on the surface of the wafer W becomes uneven, thus causing uneven polishing rate of the wafer W.

SUMMARY OF THE INVENTION

According to an embodiment, there is provided a polishing apparatus capable of correcting an inclination of a polishing head.

Embodiments, which will be described below, relate to a polishing apparatus for polishing a substrate, such as a wafer, and more particularly to a polishing apparatus having a mechanism for adjusting an inclination of a polishing head that is to press the substrate against a polishing surface.

In an embodiment, there is provided a polishing apparatus comprising: a polishing table configured to support a polishing pad thereon; a polishing head configured to press a substrate against the polishing pad; a rotational shaft coupled to the polishing head; a self-aligning rolling bearing that tiltably supports the rotational shaft; a radial rolling bearing that receives a radial load of the rotational shaft; a detector configured to detect an inclination of the rotational shaft; and an inclination adjusting device configured to adjust the inclination of the rotational shaft.

In an embodiment, the polishing apparatus further comprises a controller configured to operate the inclination adjusting device based on the inclination of the rotational shaft detected by the detector.

In an embodiment, the controller is configured to emit an alarm signal if the inclination of the rotational shaft does not fall within a predetermined range.

In an embodiment, the self-aligning rolling bearing is located between the polishing head and the radial rolling bearing, and the inclination adjusting device is coupled to the radial rolling bearing.

In an embodiment, the radial rolling bearing comprises a self-aligning rolling bearing.

In an embodiment, the radial rolling bearing comprises a combination of angular contact ball bearings.

Since the rotational shaft is supported by the self-aligning rolling bearing, the rotational shaft can tilt. Therefore, the inclination adjusting device can adjust the inclination of the rotational shaft to make the rotational shaft perpendicular to a table surface (i.e., a surface on which the polishing pad is supported) of the polishing table. As a result, a substrate, held by the polishing head, becomes parallel to the polishing surface of the polishing pad on the polishing table, and a pressure distribution of the polishing liquid (or slurry) becomes concentric with the center of the substrate. In particular, the controller operates the inclination adjusting device based on the inclination of the rotational shaft detected by the detector, so that the inclination of the rotational shaft can be adjusted automatically during polishing of the substrate.

DESCRIPTION OF EMBODIMENTS

Embodiments will be described below with reference to the drawings.

Figure 1:
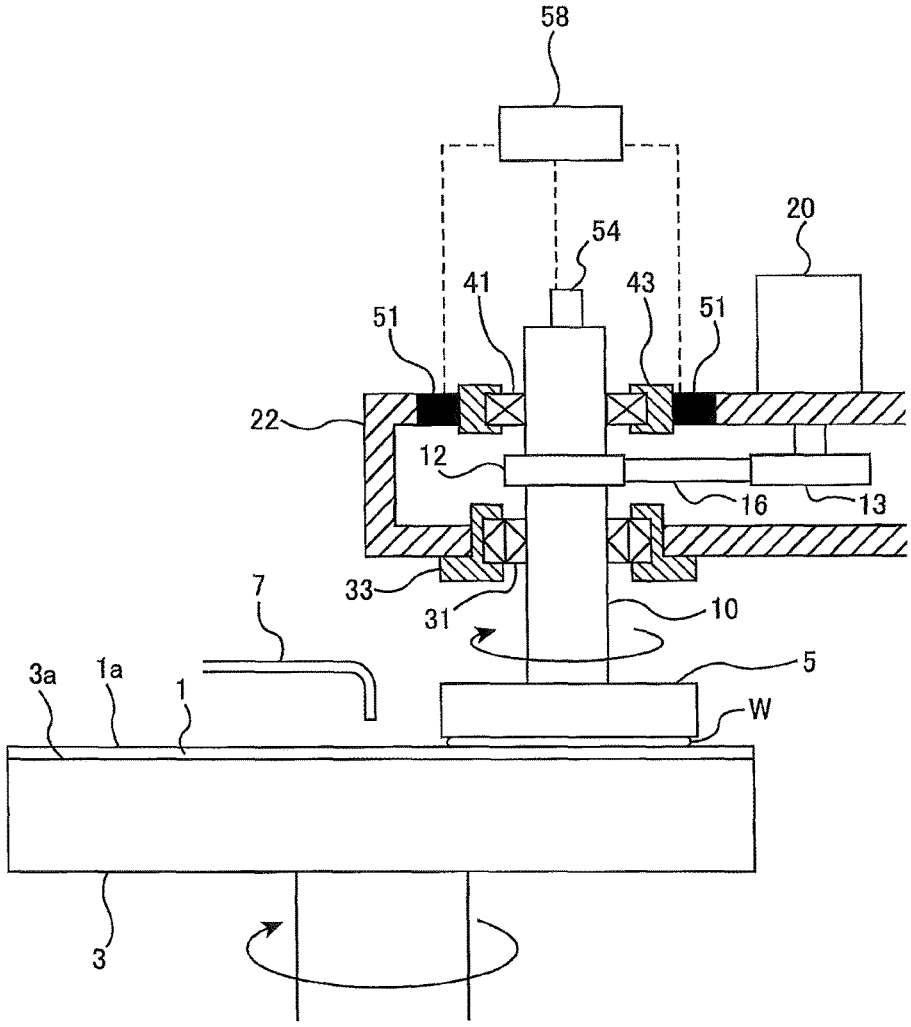
FIG. 1 is a schematic view of a polishing apparatus according to an embodiment.

FIG. 1 is a schematic view of a polishing apparatus according to an embodiment. As shown in FIG. 1, the polishing apparatus includes a rotatable polishing table 3 for supporting a polishing pad 1 thereon, a polishing head (or a substrate holder) 5 configured to hold a wafer W, which is an example of a substrate, and press the wafer W against the polishing pad 1, and a polishing liquid supply nozzle 7 configured to supply a polishing liquid (e.g., slurry) onto the polishing pad 1. The polishing table 3 has an upper surface that constitutes a table surface 3*a* to which the polishing pad 1 is attached. An upper surface of the polishing pad 1 provides a polishing surface 1*a* for polishing the wafer W.

The polishing head 5 is secured to a lower end of a rotational shaft 10, which is coupled to a motor 20 through pulleys 12, 13 and a belt 16. The motor 20 is secured to a head arm 22. When the motor 20 is set in motion, the rotational shaft 10 and the polishing head 5 are rotated about their own axes.

Polishing of the wafer W is performed as follows. The polishing table 3 and the polishing head 5 are rotated about their own axes, while the polishing liquid (or slurry) is supplied from the polishing liquid supply nozzle 7 onto the polishing surface 1*a* of the polishing pad 1 on the polishing table 3. The polishing head 5, while rotating the wafer W, presses a surface of the wafer W against the polishing surface 1*a* of the polishing pad 1. The surface of the wafer W is polished by a combination of a chemical action of the polishing liquid and a mechanical action of abrasive grains contained in the polishing liquid.

The rotational shaft 10 is rotatably supported by a self-aligning rolling bearing 31 and a radial rolling bearing 41. The self-aligning rolling bearing 31 includes an outer race that has a spherical inner circumferential surface (not shown). A center of curvature of the inner circumferential surface coincides with a center of the self-aligning rolling bearing 31. The self-aligning rolling bearing 31 includes rolling elements, such as balls or rollers, which are in rolling contact with the inner circumferential surface of the outer race. Therefore, the self-aligning rolling bearing 31 can support the rotational shaft 10 while allowing the rotational shaft 10 to tilt. Examples of the self-aligning rolling bearing 31 include a self-aligning ball bearing and a self-aligning roller bearing.

The radial rolling bearing 41 is a bearing that can carry a radial load of the rotational shaft 10. Examples of the radial rolling bearing 41 include a radial ball bearing, an angular contact ball bearing, a self-aligning ball bearing, a radial roller bearing, and a self-aligning roller bearing. The self-aligning rolling bearing 31 and the radial rolling bearing 41 used in this embodiment may be those available on the market.

The polishing head 5 is secured to the lower end of the rotational shaft 10 by fastening tool (not shown), such as screw or bolt. Therefore, the polishing head 5 is rotatable together with the rotational shaft 10 and is tiltable together with the rotational shaft 10. As described above, the self-aligning rolling bearing 31 is configured to be able to rotatably support the rotational shaft 10, while allowing the rotational shaft 10 to tilt. Accordingly, the polishing head 5 and the rotational shaft 10 can tilt around the center of the self-aligning rolling bearing 31.

The self-aligning rolling bearing 31 is held by a bearing housing 33 which is in a cylindrical shape. This bearing housing 33 is secured to a head arm 22. The radial rolling bearing 41 is held by a bearing housing 43 which is in a ring shape. This bearing housing 43 is held by inclination adjusting devices 51 each configured to adjust the inclination of the rotational shaft 10.

Figure 2:
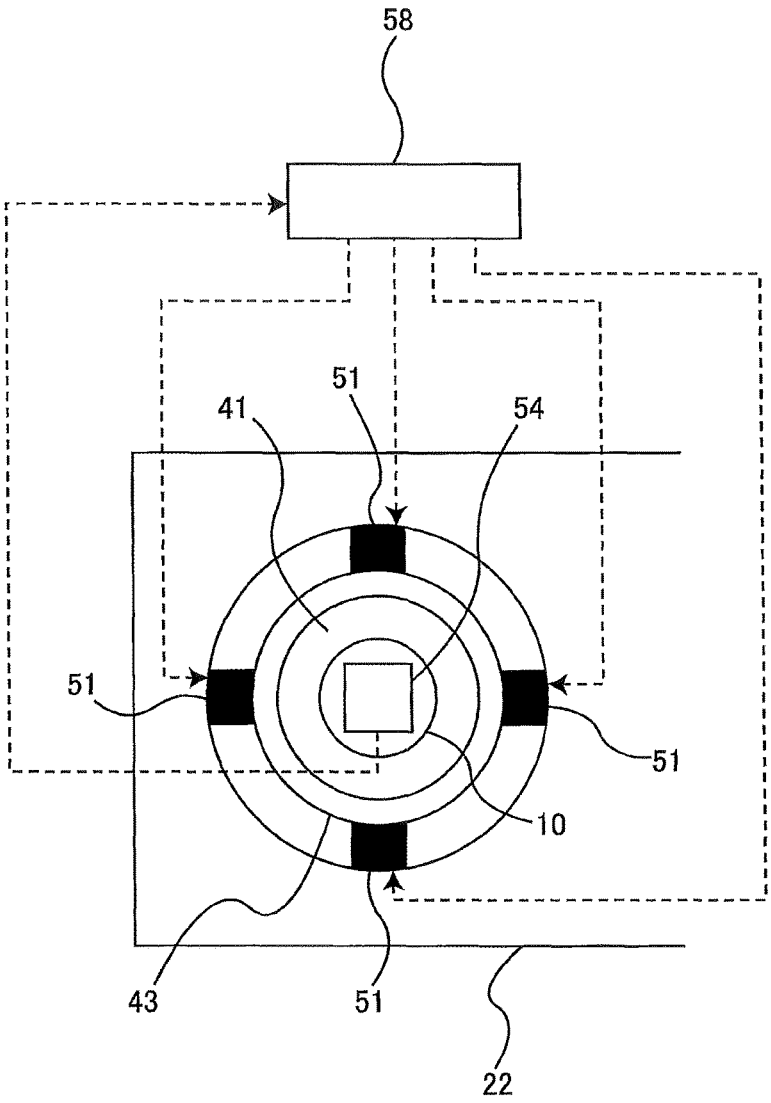
FIG. 2 shows a plan view showing inclination adjusting devices, a bearing housing, and a radial rolling bearing.

FIG. 2 shows a plan view showing the inclination adjusting devices 51, the bearing housing 43, and the radial rolling bearing 41. As shown in FIG. 2, the inclination adjusting devices 51 are arranged around the rotational shaft 10 at regular intervals. These inclination adjusting devices 51 are secured to the head arm 22 and are further secured to an outer circumferential surface of the bearing housing 43. Therefore, the inclination adjusting devices 51 are coupled to the radial rolling bearing 41 through the bearing housing 43. Each inclination adjusting device 51 is configured to push the rotational shaft 10 in a horizontal direction (or a radial direction) through the bearing housing 43 and the radial rolling bearing 41. The inclination adjusting device 51 may be a combination of a ball screw and a servomotor, a piezoelectric device, or a hydraulic cylinder.

A tilt sensor 54 is mounted to the rotational shaft 10. This tilt sensor 54 is a tilt detector for detecting the inclination of the rotational shaft 10. The polishing apparatus further includes a controller 58 configured to operate the inclination adjusting devices 51 based on an angle and a direction of the inclination of the rotational shaft 10 detected by the tilt sensor 54. This controller 58 is coupled to the tilt sensor 54 and the inclination adjusting devices 51.

Figure 3:
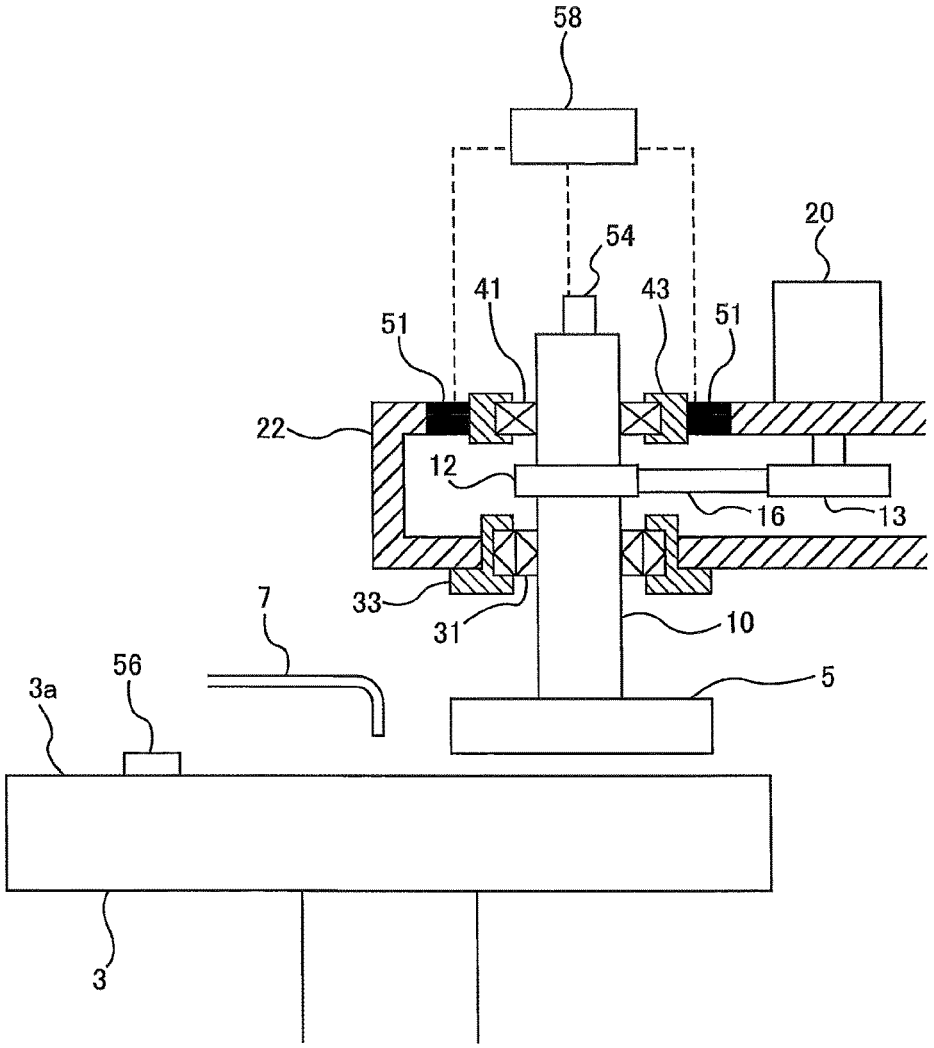
FIG. 3 is a view showing a tilt sensor mounted on a table surface of a polishing table.

When the polishing table 3 is installed, a tilt sensor 56 is mounted on the table surface 3*a* of the polishing table 3 with no polishing pad 1 attached to the polishing table 3 as shown in FIG. 3. The polishing table 3 is installed in such a state that the table surface 3*a* is horizontal. Whether the table surface 3*a* is horizontal or not can be detected by the tilt sensor 56 on the table surface 3*a*.

The controller 58 operates (or manipulates) the inclination adjusting devices 51 such that a longitudinal direction (or a central axis) of the rotational shaft 10 is in a vertical direction. More specifically, based on the angle and the direction of the inclination of the rotational shaft 10 detected by the tilt sensor 54, the controller 58 causes the inclination adjusting devices 51 to push the rotational shaft 10 in the horizontal direction (or in the radial direction) until the rotational shaft 10 becomes in the vertical position.

The above-described operations of the inclination adjusting devices 51 can keep the rotational shaft 10 perpendicular to the table surface 3*a* of the polishing table 3. A wafer holding surface (or substrate holding surface) of the polishing head 5 is kept parallel to the polishing surface 1*a* of the polishing pad 1 attached to the table surface 3*a*. As a result, the pressure distribution of the polishing liquid existing between the wafer W and the polishing pad 1 becomes concentric with the wafer W. The controller 58 may operate the inclination adjusting devices 51 during polishing of the wafer W or before polishing of the wafer W. The controller 58 is configured to emit an alarm signal if the angle of the inclination of the rotational shaft 10 does not fall within a predetermined range.

The radial rolling bearing 41 is located above the self-aligning rolling bearing 31, while the polishing head 5 is located below the self-aligning rolling bearing 31. In other words, the self-aligning rolling bearing 31 is located between the radial rolling bearing 41 and the polishing head 5. During polishing of the wafer W, the polishing head 5 receives a horizontal load that is generated due to a friction between the wafer W and the polishing pad 1. Most part of this horizontal load is received by the self-aligning rolling bearing 31. Therefore, a radial load applied to the radial rolling bearing 41 is smaller than a radial load applied to the self-aligning rolling bearing 31. Each of the inclination adjusting devices 5, which are coupled to the radial rolling bearing 41, can tilt the rotational shaft 10 with a relatively small force.

Figure 4:
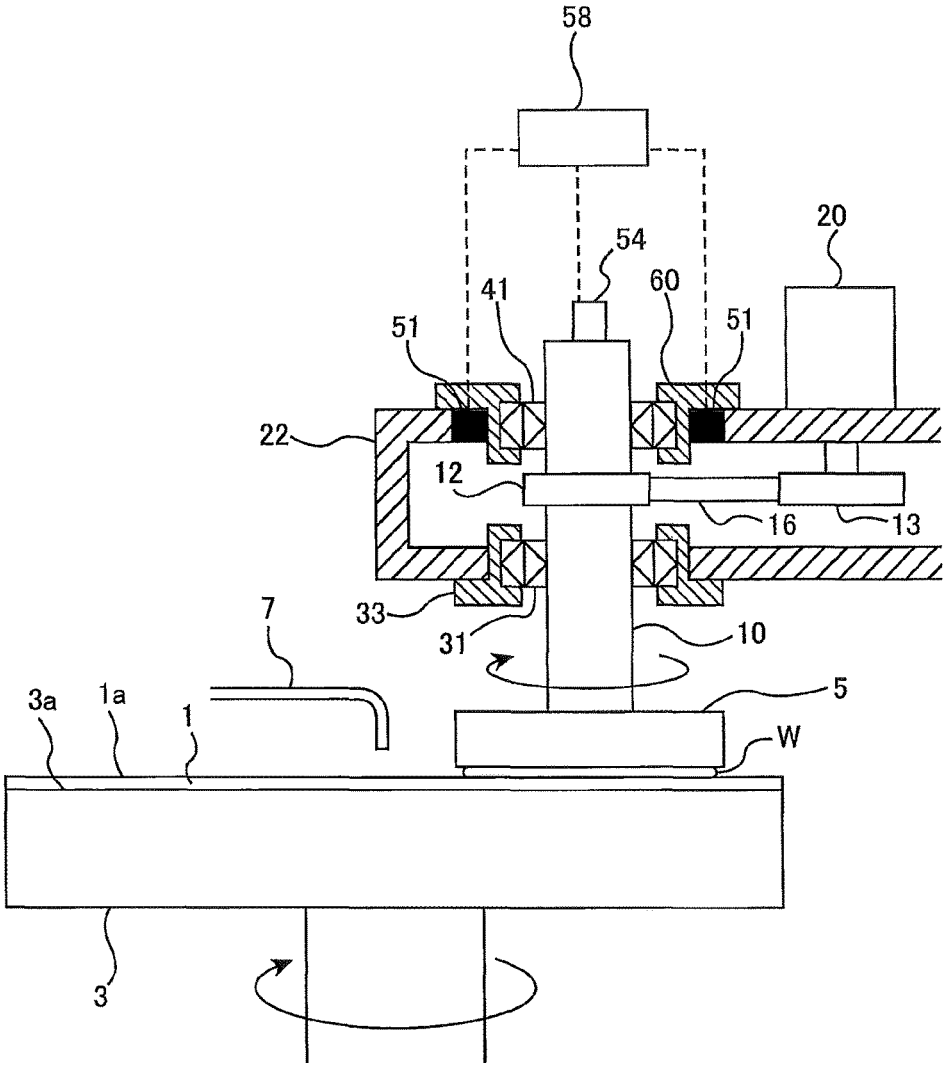
FIG. 4 is a schematic view of the polishing apparatus according to another embodiment.

FIG. 4 is a schematic view of the polishing apparatus according to another embodiment. Structures in this embodiment, which are the same as those in the embodiment shown in FIG. 1, will not be described particularly and repetitive descriptions thereof are omitted. As shown in FIG. 4, a self-aligning rolling bearing is used as the radial rolling bearing 41. This radial rolling bearing 41, which is the self-aligning rolling bearing, has the same structure as the self-aligning rolling bearing 31. The radial rolling bearing 41 is held by a bearing housing 60 which is in a cylindrical shape. This bearing housing 60 is secured to the head arm 22. Each of the inclination adjusting devices 51 is configured to push the rotational shaft 10 in the horizontal direction through the bearing housing 60 and the radial rolling bearing 41 to thereby adjust the attitude of the rotational shaft 10.

Figure 5:
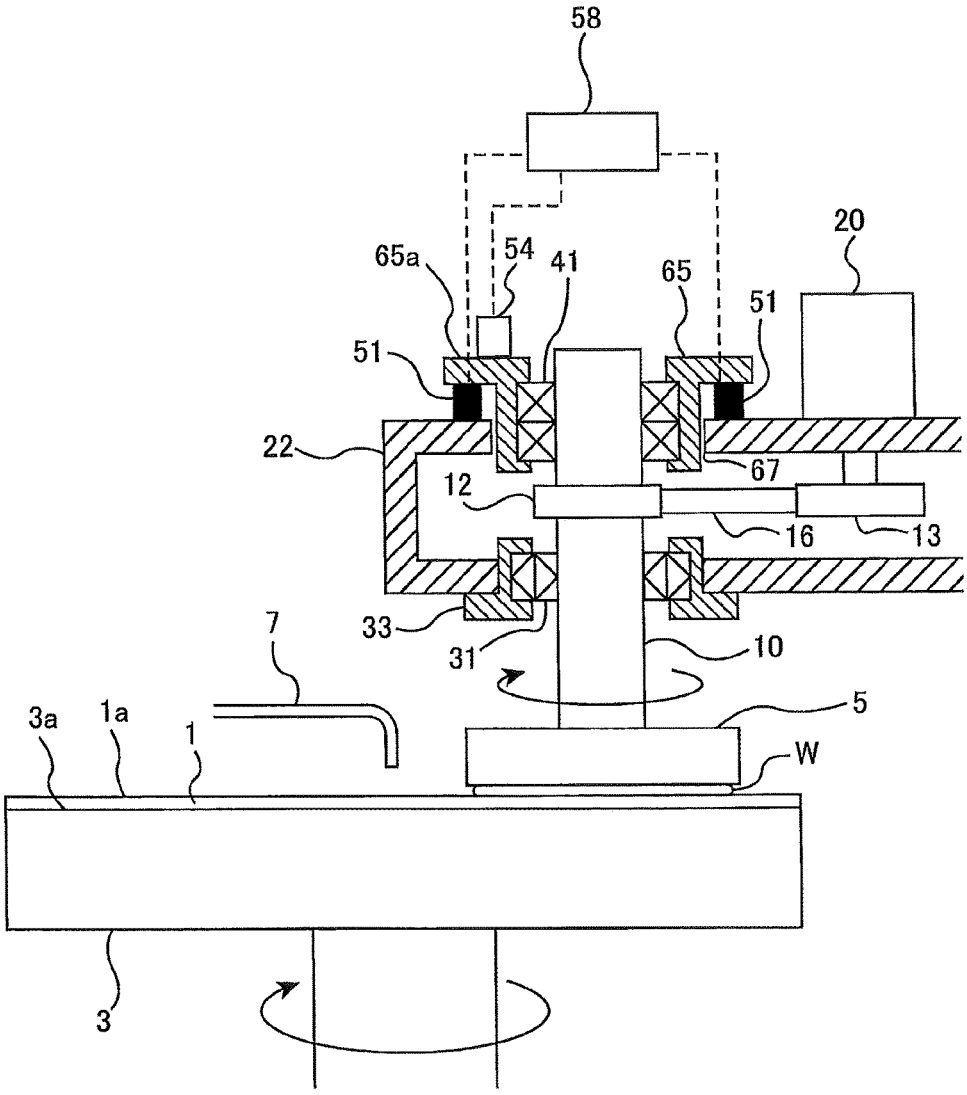
FIG. 5 is a schematic view of the polishing apparatus according to still another embodiment.

FIG. 5 is a schematic view of the polishing apparatus according to still another embodiment. Structures in this embodiment, which are the same as those in the embodiment shown in FIG. 1, will not be described particularly and repetitive descriptions thereof are omitted. As shown in FIG. 5, a combination of angular contact ball bearings is used as the radial rolling bearing 41. In this embodiment shown in FIG. 5, a combination of two angular contact ball bearings is used. The radial rolling bearing 41 that is constituted by the angular contact ball bearings is held by a bearing housing 65 which is in a cylindrical shape.

The bearing housing 65 is loosely inserted in a hole 67 formed in the head arm 22, so that the bearing housing 65 can tilt with respect to the head arm 22. The bearing housing 65 has a flange 65*a*. The inclination adjusting devices 51 are disposed between a horizontal surface (a lower surface) of the flange 65*a* and a horizontal surface (an upper surface) of the head arm 22. The inclination adjusting devices 51 are configured to push the flange 65*a* in the vertical direction (i.e., in the axial direction) to thereby tilt the entirety of the bearing housing 65, thus tilting the radial rolling bearing 41, the rotational shaft 10, and the polishing head 5. The tilt sensor 54 is mounted to the bearing housing 65. This embodiment is advantageous in a case where there is a small installation space in the radial direction for the inclination adjusting devices 51.

Figure 6:
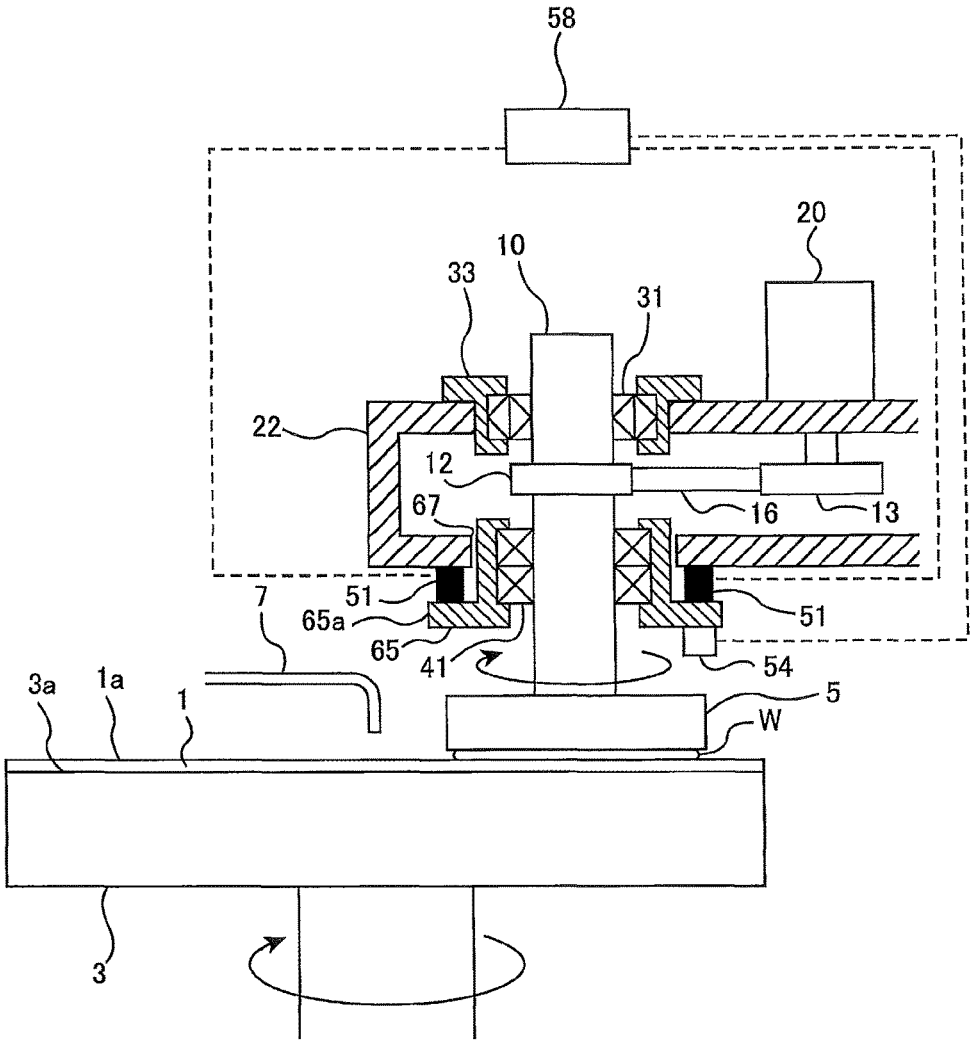
FIG. 6 is a schematic view of the polishing apparatus according to still another embodiment.
Figure 7:
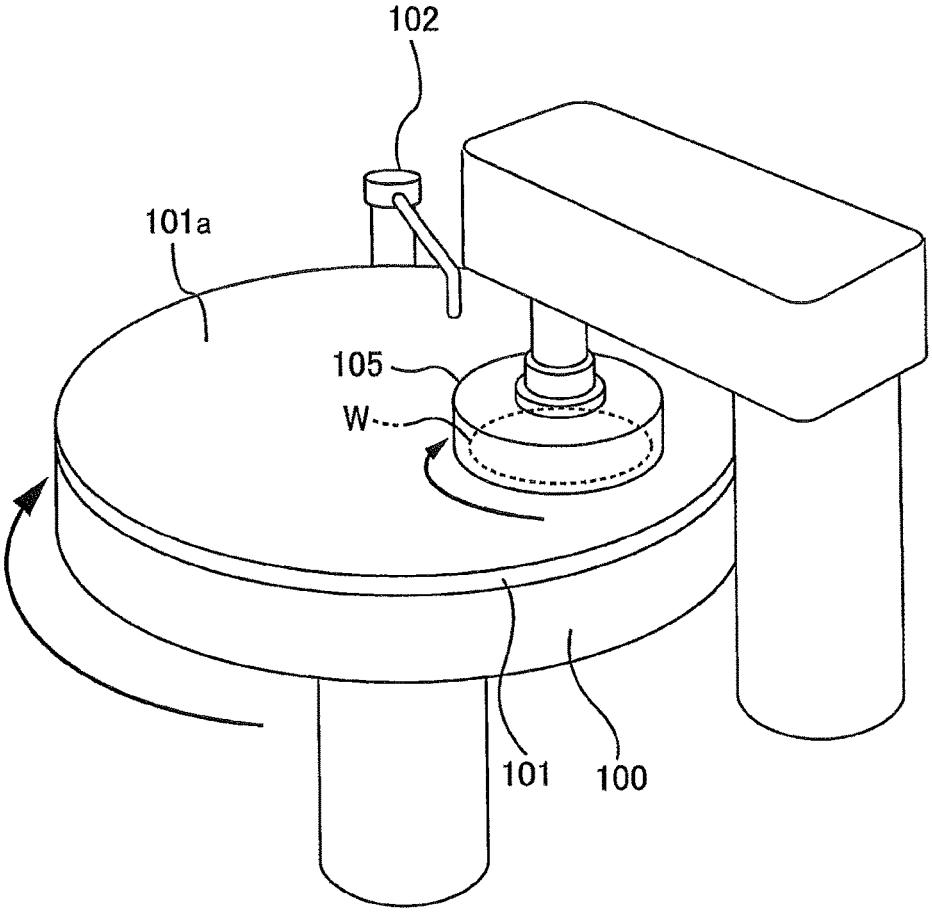
FIG. 7 is a perspective view showing a typical chemical mechanical polishing apparatus.
Figure 8:
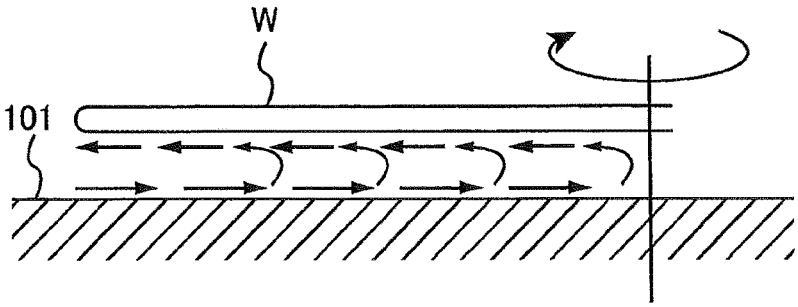
FIG. 8 a diagram showing flow of slurry formed between a wafer and a polishing pad.
Figure 9:
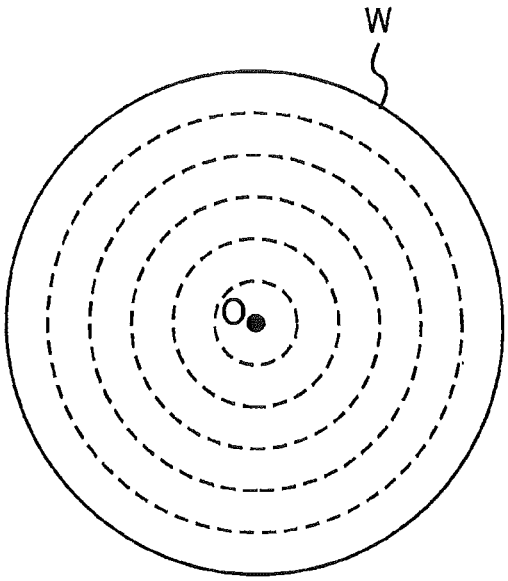
FIG. 9 a schematic diagram showing a pressure distribution of the slurry on the wafer.
Figure 10:
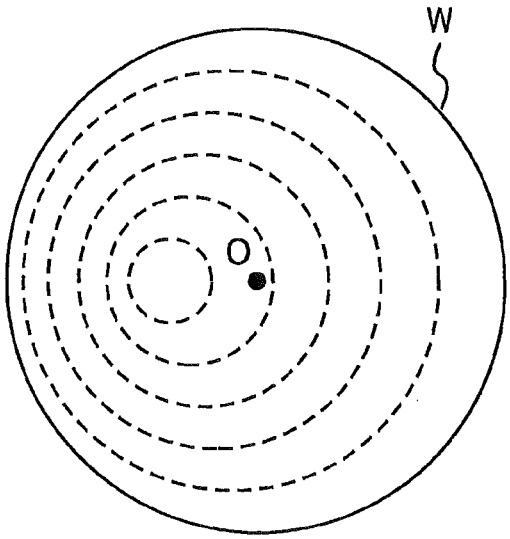
FIG. 10 a schematic diagram showing a pressure distribution of the slurry on the wafer.

FIG. 6 is a schematic view of the polishing apparatus according to still another embodiment. Structures in this embodiment, which are the same as those in the embodiment shown in FIG. 5, will not be described particularly and repetitive descriptions thereof are omitted. The inclination adjusting devices 51 are disposed between a horizontal surface (an upper surface) of the flange 65*a* and a horizontal surface (a lower surface) of the head arm 22. The inclination adjusting devices 51 are configured to push the flange 65*a* in the vertical direction (i.e., in the axial direction) to thereby tilt the entirety of the bearing housing 65, thus tilting the radial rolling bearing 41, the rotational shaft 10, and the polishing head 5.

The polishing apparatus according to the above-discussed embodiments can, during polishing of the wafer W, keep the polishing head 5 parallel to the polishing surface 1*a* of the polishing pad 1, and can further reduce a variation between polished wafers. The controller 58 may preferably emit an alarm signal if the inclination of the rotational shaft 10 does not fall within a predetermined range during polishing of the wafer W.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a polishing table configured to support a polishing pad;

a polishing head having a substrate holding surface, the polishing head being configured to hold a substrate on the substrate holding surface and press the substrate against the polishing pad;

a rotatable driving shaft secured to an upper end of the polishing head;

a first bearing contacting an outer circumferential surface of the rotatable driving shaft, the polishing head and the rotatable driving shaft being tillable together about a center of the first bearing;

a second bearing contacting the outer circumferential surface of the rotatable driving shaft, the second bearing being disposed away from the first bearing in an axial direction of the rotatable driving shaft; and a plurality of pressing devices arranged at equal intervals around the second bearing, the plurality of pressing devices being configured to press the rotatable driving shaft through the second bearing in a radial direction of the rotatable driving shaft to adjust an inclination of the rotatable shaft.

2. The polishing apparatus according to claim 1, wherein the plurality of pressing devices comprise ball screws.

3. The polishing apparatus according to claim 1, wherein the plurality of pressing devices comprise piezoelectric devices.

4. The polishing apparatus according to claim 1, wherein the first bearing comprises a self-aligning rolling bearing.

5. The polishing apparatus according to claim 1, wherein the second bearing comprises a radial rolling bearing.

6. The polishing apparatus according to claim 1, wherein the second bearing is located higher than the first bearing.

7. The polishing apparatus according to claim 1, wherein the rotatable driving shaft is directly secured to the upper end of the polishing head.

8. The polishing apparatus according to claim 7, wherein the rotatable driving shaft is directly secured to the upper end of the polishing head by at least one screw.

9. The polishing apparatus according to claim 7, wherein the rotatable driving shaft is directly secured to the upper end of the polishing head by at least one bolt.

10. The polishing apparatus according to claim 1, wherein the head arm rotatably supports the rotatable driving shaft via the first bearing and the second bearing.

11. The polishing apparatus according to claim 1, wherein the head arm is located above the polishing head.

* * * * *